US008004267B2

(12) United States Patent
Chen et al.

(10) Patent No.: US 8,004,267 B2
(45) Date of Patent: Aug. 23, 2011

(54) POWER CONVERTER SYSTEM FOR AN AUTOMOTIVE VEHICLE AND METHOD FOR CONFIGURING SAME

(75) Inventors: Chingchi Chen, Ann Arbor, MI (US); Michael W. Degner, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 541 days.

(21) Appl. No.: 11/842,326

(22) Filed: Aug. 21, 2007

(65) Prior Publication Data

US 2009/0052213 A1 Feb. 26, 2009

(51) Int. Cl.
*H01F 27/28* (2006.01)

(52) U.S. Cl. ..... 323/346; 439/504; 336/147

(58) Field of Classification Search ..... 323/346, 323/355; 363/146; 439/504, 46, 503, 620.2, 439/620.22; 307/10.1; 336/145–147
See application file for complete search history.

(56) References Cited

U.S. PATENT DOCUMENTS

| | | | | |
|---|---|---|---|---|
| 3,719,910 | A * | 3/1973 | Golaski | 336/146 |
| 3,996,546 | A * | 12/1976 | Hugly | 336/107 |
| 4,181,389 | A | 1/1980 | Kiesel et al. | |
| 5,297,015 | A * | 3/1994 | Miyazaki et al. | 363/146 |
| 5,859,884 | A | 1/1999 | Metro et al. | |
| 5,973,948 | A * | 10/1999 | Hahn et al. | 363/146 |
| 6,222,443 | B1 * | 4/2001 | Beeson et al. | 340/431 |
| 6,386,887 | B2 | 5/2002 | Boiret et al. | |
| 6,431,892 | B1 | 8/2002 | Shupe et al. | |
| 6,724,100 | B1 * | 4/2004 | Gabriel | 307/9.1 |
| 6,951,268 | B2 | 10/2005 | Guettler | |
| 7,028,202 | B2 * | 4/2006 | Long et al. | 713/340 |
| 2006/0254806 | A1 * | 11/2006 | White et al. | 174/135 |

FOREIGN PATENT DOCUMENTS

WO 9749166 12/1997

* cited by examiner

*Primary Examiner* — Harry Behm
(74) *Attorney, Agent, or Firm* — David B. Kelley; Brooks Kushman P.C.

(57) ABSTRACT

A DC/DC power converter includes an electrically configurable transformer/inductor. The electrically configurable transformer/inductor receives a power plug. The power plug, depending on its configuration, configures the operation of the transformer/inductor and therefore the DC/DC power converter. The power plug may permit access to power received from the power converter. The power plug may also pass power to the power converter from a remote electrical source.

17 Claims, 4 Drawing Sheets

POWER CONVERTER SYSTEM FOR AN AUTOMOTIVE VEHICLE AND METHOD FOR CONFIGURING SAME

BACKGROUND

1. Field of the Invention

The invention relates to power converter systems for automotive vehicles and methods for configuring the same.

2. Discussion

An alternatively powered vehicle may include an energy storage unit, e.g., battery. A DC/DC power converter may be used to convert power from the energy storage unit for use, for example, by a motor of the alternatively powered vehicle. As such, power from the energy storage unit may be used to move the vehicle.

SUMMARY

Embodiments of the invention may take the form of a power converter system for an automotive vehicle. The system includes a power converter for receiving power at a first voltage and presenting power at a second voltage. The power converter includes an electrically configurable transformer for receiving a removable electrical plug. The plug, when received, electrically configures the transformer.

Embodiments of the invention may take the form of a removable electrical plug system for a vehicle power converter including an electrically configurable transformer. The system includes a removable electrical plug for configuring the electrical operation of the transformer. The plug includes electrical contacts for electrically connecting the plug with the transformer, for electrically configuring the transformer, and for enabling the power converter to enter an active state.

Embodiments of the invention may take the form of a method for electrically configuring a power converter system for an automotive vehicle. The method includes providing a power converter configured to receive power at a first voltage and present power at a second voltage. The power converter includes an electrically configurable transformer for receiving a removable electrical plug. The method also includes providing a removable electrical plug for configuring the electrical operation of the electrically configurable transformer. The method further includes electrically connecting the removable electrical plug with the electrically configurable transformer.

While exemplary embodiments in accordance with the invention are illustrated and disclosed, such disclosure should not be construed to limit the claims. It is anticipated that various modifications and alternative designs may be made without departing from the scope of the invention.

DETAILED DESCRIPTION

A power converter, e.g., high power DC/DC converter, of an alternatively powered vehicle, e.g., a hybrid electric vehicle (HEV), may be configured for multiple applications. For example, isolated output power may be extracted from the DC/DC converter and processed by another on-board or off-board/portable converter to yield a 50/60 Hz AC output for a wide range of applications, e.g., residential power.

Some converter topologies, e.g., bi-directional DC/DC converter topologies, shuffle power between an input and an output. If an inductor of a converter is replaced by a transformer with one or more isolated secondary windings, the converter may also provide isolated output power. This isolated power may be converted to, for example, 50/60 Hz AC by an additional power converter.

Primary and secondary windings of some transformers may be connected in parallel or in series. This may increase component utilization and may improve system performance. Connecting the primary and secondary windings in parallel, if they have the same number of turns, may increase the current rating of the converter and/or reduce inductor copper loss. Connecting the primary and second windings in series may increase the inductance of the choke which may decrease ripple current and iron loss.

If secondary windings of a power converter serve dual functions, a controller may cease operation of the converter before the converter is reconfigured. Interlocks may be incorporated in a power connector, e.g., plug, which permit access to power from the converter. Some interlocks may be designed so that they are disconnected prior to any main connections.

Universal plug housings may be designed such that different interconnections may be installed on different sides, orientations, angles, locations, etc., of the plug housing. As such, the function of a power converter may depend on how the plug is inserted. For example, a plug may be configured such that if it is inserted one way, primary and secondary windings of a transformer of the converter are connected in parallel and if it is inserted another way, the primary and secondary windings are connected in series. Other configurations are also contemplated. For example, a plug may include interconnections that determine a desired output voltage or numbers of outputs, etc.

Figure 1:
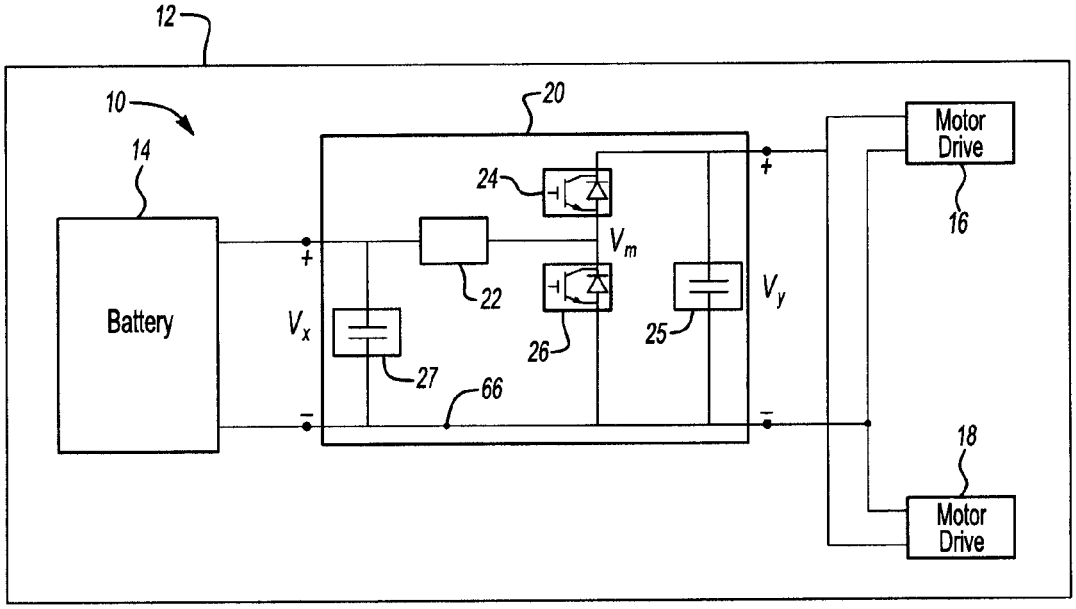
FIG. 1 is a schematic diagram of a portion of an example power distribution system for an automotive vehicle including a DC/DC power converter.

FIG. 1 is a schematic diagram of power system 10 of vehicle 12. Power system 10 includes high voltage battery 14, motor drives 16, 18, and DC/DC power converter 20. Battery 14 is electrically connected with motor drives 16, 18 via power converter 20. In other embodiments, other loads and sources, e.g., fewer motor drives, additional batteries, etc., may be electrically connected with power converter 20.

Power converter 20 of FIG. 1 includes inductor/transformer 22, switches 24, 26, and capacitors 25, 27. By selectively switching switches 24, 26, power converter 20 may, for example, receive power, e.g., $V_x$, from battery 14 and boost it to, for example, $V_y$ for use by motor drives 16, 18. Power converter 20 may also receive power from motor drives 16, 18, e.g., $V_y$, and buck it to, for example $V_x$ for subsequent storage by battery 14. Table 1 summaries example values that $V_x$, $V_y$, and $V_m$ may achieve:

TABLE 1

| $V_x$ (volts) | $V_y$ (volts) | $V_m$ (volts) |
|---|---|---|
| 300 | 300-500 | 0-$V_y$ |

In other embodiments, power converter 20 may take on other topologies such that, for example, it behaves as a uni-direction boost converter, etc.

Figure 2:
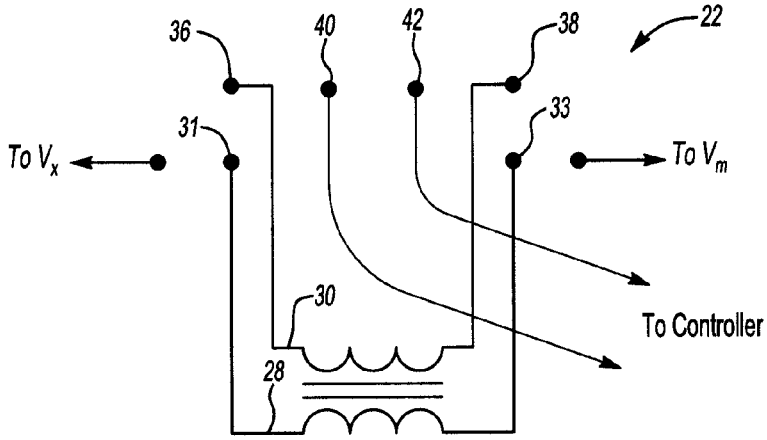
FIG. 2 is a schematic diagram of an example transformer of the DC/DC power converter of FIG. 1.
Figure 3:
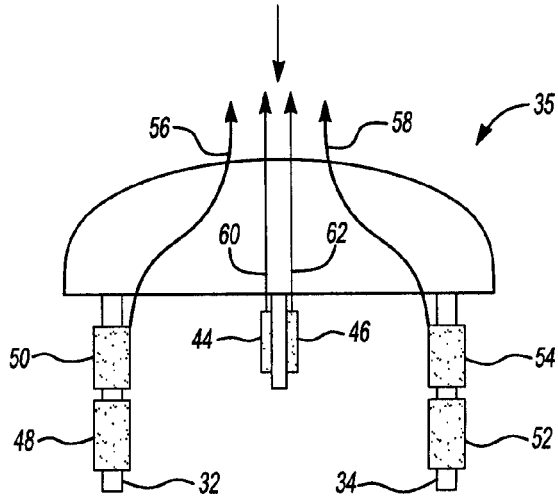
FIG. 3 is a schematic diagram of an example power plug that may be used with the transformer of FIG. 2.

FIG. 2 is a schematic diagram of an embodiment of inductor/transformer 22. Inductor/transformer 22 of FIG. 2 includes primary coil 28 and secondary coil 30. Primary coil 28 of FIG. 2 includes terminals 31, 33. Terminals 31, 33 may be electrically connected with $V_x$ and $V_m$ respectively via prongs 32, 34 (FIG. 3) respectively of power plug 35 (FIG. 3). Secondary coil 30 of FIG. 2 includes terminals 36, 38. Terminals 36, 38 may also be electrically connected with prongs 32, 34 of power plug 35. In other embodiments, inductor/transformer 22 may have more than two terminals, e.g., 6, etc., depending on design requirements. In the absence of power plug 35, power converter 20 would remain inactive as $V_x$ and $V_m$ would not be electrically connected.

Figure 4:
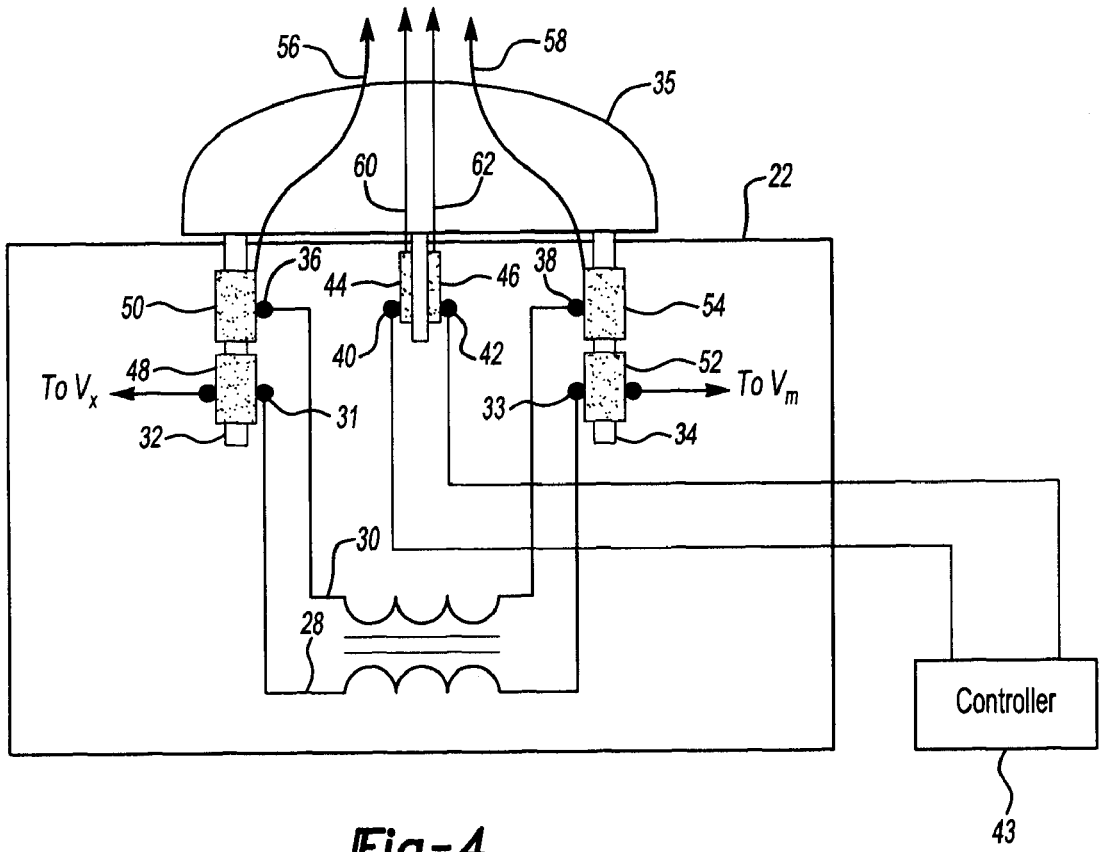
FIG. 4 is a schematic diagram of the transformer and power plug of FIGS. 2 and 3 respectively.

Interlock terminals 40, 42 are electrically connected with controller 43 (FIG. 4). Interlock terminals 40, 42 may be electrically connected with interlock conductors 44, 46 (FIG. 3) of power plug 35 (FIG. 3). As discussed below, this electrical connection may facilitate communication with controller 43.

FIG. 3 is a schematic diagram of power plug 35. Prong 32 includes electrical conductors 48, 50 and prong 34 includes electrical conductors 52, 54. Electrical conductors 50, 54 are electrically connected with power leads 56, 58 respectively. Power leads 56, 58 permit, for example, electrical devices, e.g., a power tool, to access power subsequently from battery 14 (FIG. 1) via power converter 20 (FIG. 1) and power plug 35. Power leads 56, 58 also permit, for example, electrical power sources to store energy in battery 14 via power plug 35 and converter 20.

Interlock conductors 44, 46 are electrically connected with interlock leads 60, 62. As discussed below, this electrical connection may facilitate communication with controller 43.

FIG. 4 is a schematic diagram of power plug 35 plugged with inductor/transformer 22. When plugged, electrical conductors 48, 52 electrically connect terminals 31, 33 of primary coil 28 with $V_x$ and $V_m$ respectively. Electrical conductors 50, 54 electrically connect terminals 36, 38 with power leads 56, 58 respectively. As such, power leads 56, 58 provide power that is, for example, galvanically isolated from battery 14 (FIG. 1).

Interlock conductors 44, 46 electrically connect controller 43 with interlock leads 60, 62. In alternative embodiments, some number of interlock leads other than two, e.g., four, may be provided. In the embodiment of FIG. 4, electrical devices may communicate with controller 43 via this electrical connection. For example, communication signals may be sent from controller 43 to an electrical device through interlock terminals 40, 42, interlock conductors 44, 46, and interlock leads 60, 62. Likewise, communication signals may be sent from an electrical device to controller 43 via interlock leads 60, 62, interlock conductors 44, 46, and interlock terminals 40, 42. In other embodiments, such communication may take place via optics, e.g., fiber optics, infrared, etc., or via non-contact electromagnetics.

Figure 5:
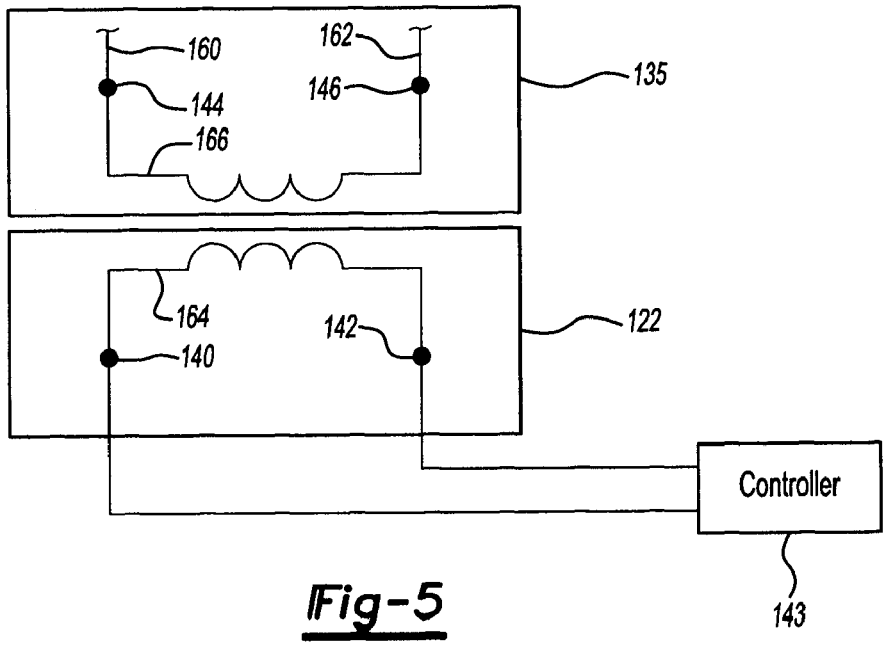
FIG. 5 is a schematic diagram of a portion of another example transformer of the DC/DC power converter of FIG. 1 and a portion of another example power plug that may be used with the transformer.

FIG. 5 is a schematic diagram of a portion of inductor/transformer 122 and power plug 135. Numbered elements differing by factors of 100 have similar, although not necessarily identical, descriptions, e.g., controller 43, 143. Coil 164 spans interlock terminals 140, 142. Coil 166 spans interlock conductors 144, 146. Electrical signals sent through coil 164 from controller 143 induce electrical signals through coil 166. Likewise, electrical signals sent through coil 166 from, for example, an electrical device, induce electrical signals through coil 164.

Figure 6:
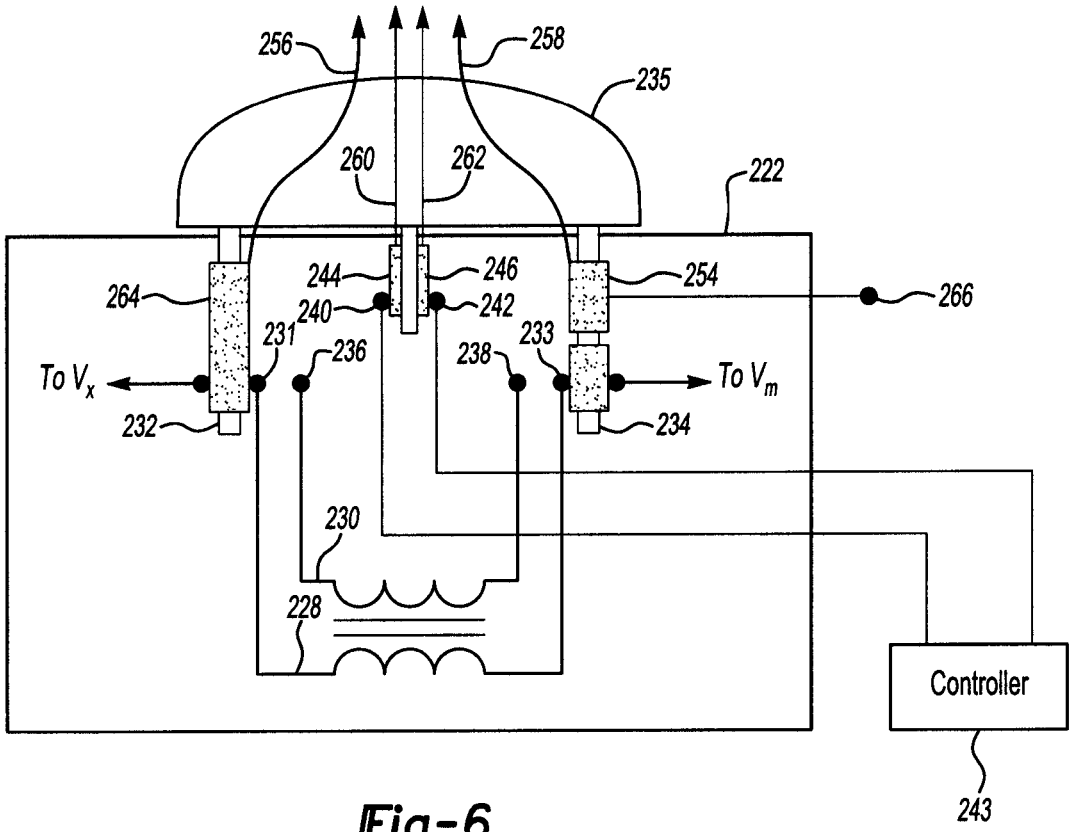
FIG. 6 is a schematic diagram of another example transformer of FIG. 1 and another example power plug that may be used with the transformer.

FIG. 6 is a schematic diagram of inductor/transformer 222 and power plug 235. Electrical conductor 264 electrically connects primary coil 228 with $V_x$ and power lead 256. Electrical conductor 254 electrically connects power lead 258 with common terminal 266, e.g., ground. As such, power leads 256, 258 provide power that is, for example, not isolated from battery 214 (not shown).

Figure 7:
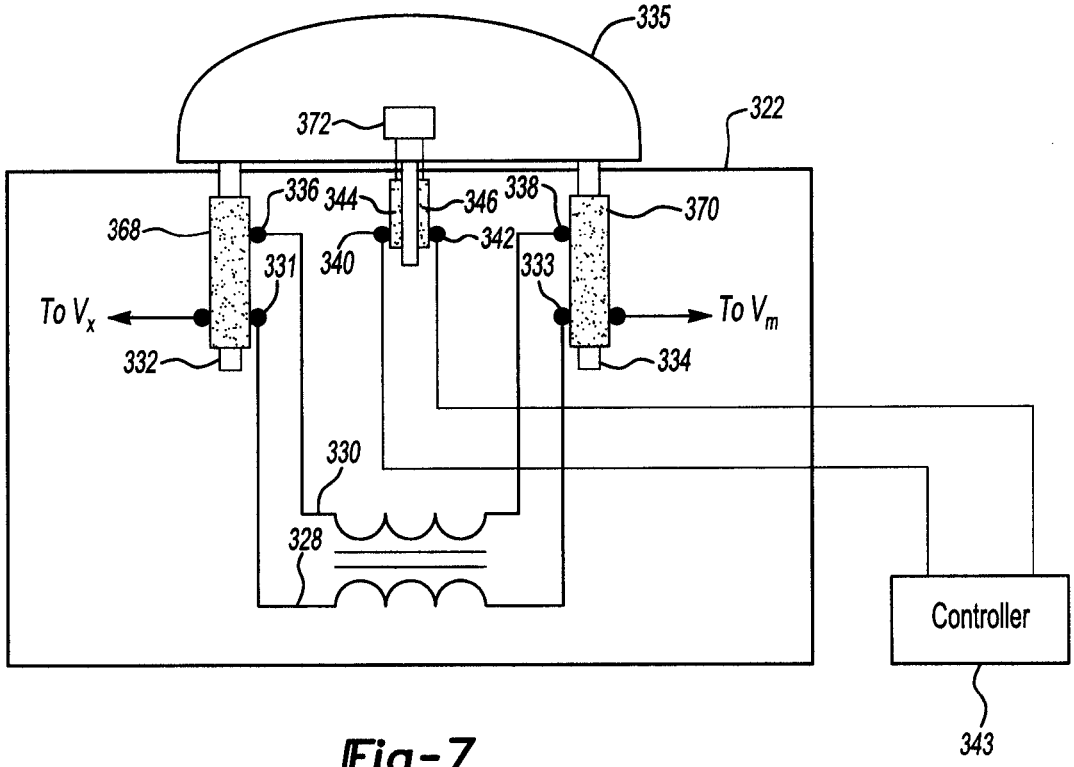
FIG. 7 is a schematic diagram of yet another example transformer of FIG. 1 and yet another example power plug that may be used with the transformer.

FIG. 7 is a schematic diagram of inductor/transformer 322 and power plug 335. Electrical conductors 368, 370 electrically connect primary coil 328 in parallel with secondary coil 330.

Power plug 335 includes electronic tag 372, e.g., a resistor having a predetermined resistance, a capacitor having a predetermined capacitance, etc. Controller 343 may determine which type of power plug is plugged with inductor/transformer 322 by, for example, sending a signal though interlock terminals 340, 342, and interlock conductors 344, 346 and measuring the change in voltage of the signal received. For example, power plug 135 (FIG. 4) may have an electronic tag (not shown) that results in, for example, a 1 V drop in voltage. Power plug 235 (FIG. 6) may have electronic tag (not shown) that results in, for example, a 2 V drop in voltage.

Figure 8:
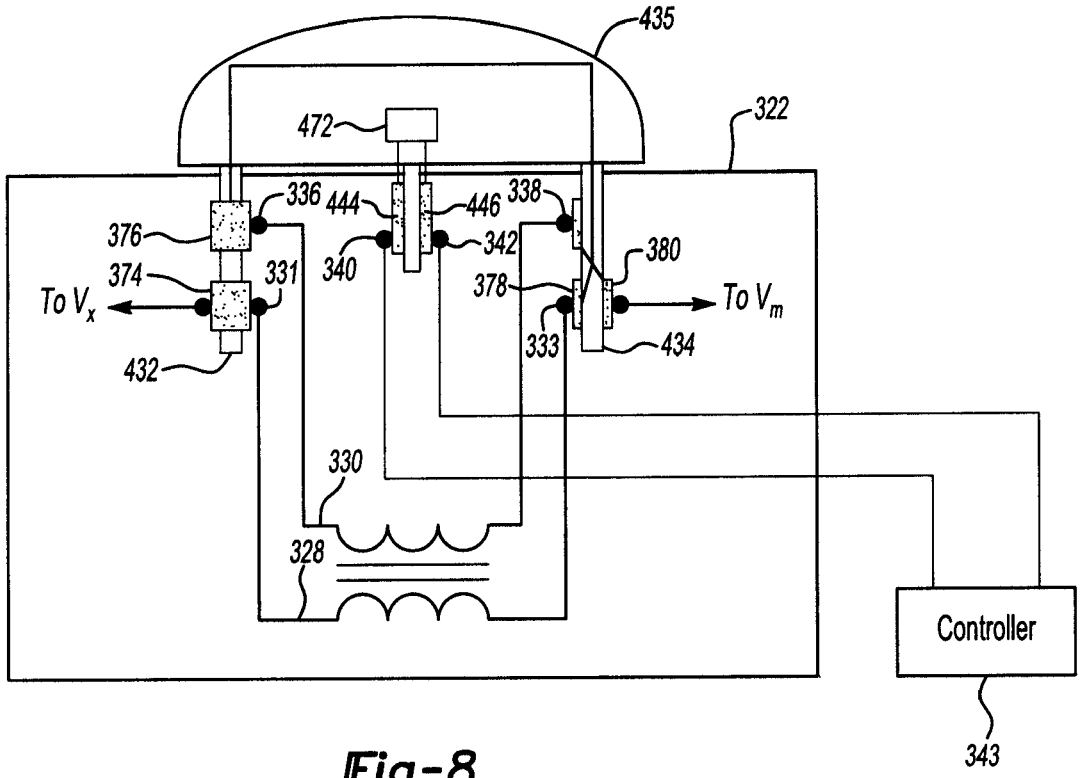
FIG. 8 is a schematic diagram of the transformer of FIG. 7 and still another example power plug that may be used with the transformer.

FIG. 8 is a schematic diagram of inductor/transformer 322 and power plug 435. Electrical conductors 374, 376, 378, 380 electrically connect primary coil 328 in series with secondary coil 330. Electronic tag 472 includes an active circuit that may, for example, produce a series of pulsed signals in response to a power/signal sent by controller 343.

Figure 9:
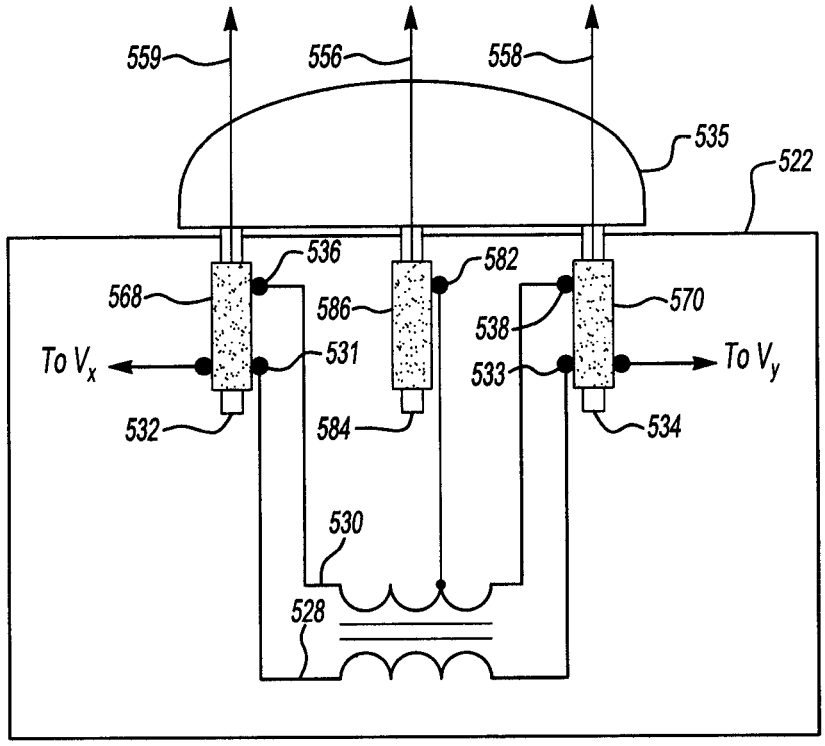
FIG. 9 is a schematic diagram of still yet another example transformer of FIG. 1 and still yet another example power plug that may be used with the transformer.

FIG. 9 is a schematic diagram of inductor/transformer 522 and power plug 535. Electrical conductors 568, 570 electrically connect primary coil 528 in parallel with secondary coil 530. Prong 584 includes electrical conductor 586. Power lead 556 is electrically connected with terminal 582 via electrical conductor 586. Power lead 558 is electrically connected with terminals 533, 538 via electrical conductor 570. Power lead 559 is electrically connected with terminals 531, 536 via electrical conductor 568. As such, power leads 556, 558, 559 provide AC power that is not isolated from battery 514 (not shown).

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed:

1. A power converter system for an automotive vehicle comprising:

a power converter configured to receive power at a first voltage and present power at a second voltage and including (i) an electrically configurable transformer having a plurality of electrical terminals and primary and secondary coils each electrically connected with some of the terminals and (ii) a removable electrical plug configured to be received by the transformer and having a plurality of prongs each with an electrical conductor disposed thereon; and a controller electrically connected with other of the terminals and configured to control the power converter, wherein the conductors contact the terminals when the plug is received by the transformer to electrically configure the coils of the transformer and to establish a communication link between the plug and the controller.

2. The system of claim 1 wherein the removable electrical plug is further configured to present at least a portion of the received power to an electrical load remote from the vehicle.

3. The system of claim 1 wherein the removable electrical plug is further configured to receive power from an electrical source remote from the vehicle and present the received power to the power converter.

4. The system of claim 1 wherein the removable electrical plug includes an identifier and wherein the controller is further configured to read the identifier.

5. The system of claim 4 wherein the identifier comprises a passive element.

6. The system of claim 4 wherein the identifier comprises an active element.

7. The system of claim 1 wherein the removable electrical plug is further configured to permit the controller to communicate with an electrical device remote from the vehicle.

8. The system of claim 7 wherein the removable electrical plug further includes a communication medium to pass communications between the controller and electrical device remote from the vehicle.

9. The system of claim 8 wherein the communication medium comprises a non-contact coupling.

10. The system of claim 1 wherein the power converter has an active state and an inactive state and wherein the power converter enters the inactive state if the removable electrical plug is not electrically connected with the electrically configurable transformer.

11. The system of claim 1 wherein the removable electrical plug configures the electrically configurable transformer such that it behaves as an inductor.

12. A removable electrical plug system for a vehicle power converter (i) configured to receive power at a first voltage and present power at a second voltage different than the first voltage by a predetermined amount, (ii) including an electrically configurable transformer configured to receive a removable electrical plug and having a plurality of electrical terminals and primary and secondary coils each electrically connected with some of the terminals, the system comprising:

a removable electrical plug including a plurality of prongs each with an electrical conductor disposed thereon; and a controller electrically connected with other of the terminals and configured to control the power converter, wherein the conductors contact the terminals when the plug is received by the transformer to electrically configure the coils of the transformer and to establish a communication link between the plug and the controller.

13. The system of claim 12 wherein the removable electrical plug is configured to present at least a portion of the received power from the power converter to a remote electrical load.

14. The system of claim 12 wherein the removable electrical plug is configured to receive power from a remote electrical source and present the received power to the power converter.

15. The system of claim 12 wherein the removable electrical plug includes a communication medium to pass communications between the controller and a remote electrical device.

16. The system of claim 12 wherein the removable electrical plug includes an identifier configured to be read by the controller.

17. An automotive vehicle comprising:

a battery;

at least one motor drive; and a power converter configured to receive power from the battery at a first voltage and present power to the at least one motor drive at a second voltage and including (i) an electrically configurable transformer having a plurality of electrical terminals and primary and secondary coils each electrically connected with some of the terminals and (ii) a removable electrical plug configured to be received by the transformer and having a plurality of prongs each with an electrical conductor disposed thereon; and a controller electrically connected with other of the terminals and configured to control the power converter, wherein the conductors contact the terminals when the plug is received by the transformer to electrically configure the coils of the transformer and to establish a communication link between the plug and the controller.

* * * * *